US005940673A

United States Patent [19]

Han

[11] Patent Number: 5,940,673

[45] Date of Patent: Aug. 17, 1999

[54] PHOTORECEPTOR BELT CLEANING APPARATUS OF LIQUID ELECTROPHOTOGRAPHIC PRINTER

[75] Inventor: Cheol-young Han, Suwon, Rep. of Korea

[73] Assignee: Samsung Electronics Co., Ltd., Kyungki-Do, Rep. of Korea

[21] Appl. No.: 09/088,734

[22] Filed: Jun. 2, 1998

[30] Foreign Application Priority Data

Aug. 27, 1997 [KR] Rep. of Korea ..... 97-41605

[51] Int. Cl.[6] ..... G03G 21/00

[52] U.S. Cl. ..... 399/348; 399/349

[58] Field of Search ..... 399/348, 349, 399/350, 355, 358, 343, 71, 249; 15/1.51, 300.1, 302, 320, 256.5; 134/21, 122 R, 93

[56] References Cited

U.S. PATENT DOCUMENTS 4,501,486 2/1985 Landa ..... 399/348
5,175,591 12/1992 Dunn et al. ..... 399/349 X
5,359,398 10/1994 Echigo et al. ..... 399/71
5,530,538 6/1996 Godlove ..... 399/349
5,596,398 1/1997 Woo et al. ..... 399/350
5,640,655 6/1997 Shoji ..... 399/249

*Primary Examiner*—William Royer
*Assistant Examiner*—Sophia S. Chen
*Attorney, Agent, or Firm*—Sughrue, Mion, Zinn, Macpeak & Seas, PLLC

[57] ABSTRACT

A photoreceptor belt cleaning apparatus of a liquid electrophotographic printer includes a photoreceptor belt circulating and supported by a plurality of rollers, a housing installed to be adjacent to the photoreceptor belt, a brush supported on the housing to be brought into contact with the photosensitive surface of the photoreceptor belt, a cleaning blade installed on the downstream side of the brush in a traveling direction of the photoreceptor belt so that its leading edge contacts the photoreceptor belt, a nozzle installed in the housing so that a suction inlet is disposed around the leading edge of the cleaning blade, and a pump connected to the nozzle so as to provide vacuum suction through the suction inlet.

7 Claims, 3 Drawing Sheets

PHOTORECEPTOR BELT CLEANING APPARATUS OF LIQUID ELECTROPHOTOGRAPHIC PRINTER

BACKGROUND OF THE INVENTION

1. Field of the Invention

The present invention relates to a liquid electrophotographic printer, and more particularly, to a photoreceptor belt cleaning apparatus for removing residual developer liquid and foreign matter remaining on a photoreceptor belt used as a photoreceptor medium.

2. Description of the Related Art

In general, in an electrophotographic printer, an electrostatic latent image formed on a photoreceptor medium such as a photoreceptor drum or a photoreceptor belt is developed using developer liquid having a toner mixed with a volatile liquid carrier and is transferred to a sheet, thereby printing a desired image.

Referring to FIG. 1 schematically showing a conventional liquid electrophotographic color printer, a photoreceptor belt 110 supported by a plurality of rollers 121, 122, and 123, circulates around the rollers 121, 122 and 123. The surface of the photoreceptor belt 110 is charged to a predetermined level by a charging station 150. Then, an electrostatic latent image is formed on the photoreceptor belt 110 by a laser scanning unit 130 for irradiating a laser beam onto the photoreceptor belt 110 according to image signals. The electrostatic latent image is developed by a development station 140 for supplying developer liquid. As shown in FIG. 1, in the case of a color printer, a plurality of laser scanning units 130 and a plurality of development stations 140 are provided corresponding to various colors.

Each of the development stations 140 includes a development roller 141, a cleaning roller 142, and squeegee rollers 144 and 146 directly under the photoreceptor belt 110, and accommodates developer liquid 148, in which a toner having a predetermined color and a liquid carrier are mixed, as shown in FIG. 2. Reference numeral 143 represents a developer liquid supplier for supplying developer liquid 148 between the development roller 141 and the photoreceptor belt 110.

The squeegee rollers 144 and 146 remove the excess developer liquid 148 remaining after the developer liquid 148 is utilized for developing the electrostatic latent image. The removed developer liquid is withdrawn into the development station 140 by blades 145 and 147.

The liquid carrier contained in the developer liquid 148 embedded on the electrostatic latent image of the photoreceptor belt 110 is evaporated while passing an image drying station 160 and then only the toner remains, thereby completing the development of the image.

Subsequently, the developed image is transferred to a sheet 126 fed between a transfer roller 124 and a fixing roller 125 via the transfer roller 124, to then be printed. Thereafter, an electrostatic charge remaining on the photoreceptor belt 110 is removed by an erasure station 170.

Here, after the developed image of the photoreceptor belt 110 is transferred to the sheet 126, the toner must be completely removed from the photoreceptor belt 110. However, in the event that the developed image is not perfectly transferred to the transfer roller 124, some toner sludge may remain on the photoreceptor belt 110. Also, foreign matter of the printer may stick to the photoreceptor belt 110 while the photoreceptor belt 110 circulates. The residual toner or foreign matter on the photoreceptor belt 110 may deteriorate the quality of development in repetitive printing procedures, thereby adversely affecting the printing quality of the image.

SUMMARY OF THE INVENTION

To solve the above problem, it is an objective of the present invention to provide a photoreceptor belt cleaning apparatus for removing toner sludge or contaminants stuck on the photosensitive surface of a photoreceptor belt.

Accordingly, to achieve the above objective, there is provided a photoreceptor belt cleaning apparatus of a liquid electrophotographic printer comprising: a photoreceptor belt circulating and supported by a plurality of rollers; a housing installed to be adjacent to the photoreceptor belt; a brush supported on the housing to be brought into contact with the photosensitive surface of the photoreceptor belt; a cleaning blade installed in the downstream side of the brush in a traveling direction of the photoreceptor belt so that its leading edge contacts the photoreceptor belt; a nozzle installed in the housing so that a suction inlet is disposed around the leading edge of the cleaning blade; and a pump connected to the nozzle so as to provide vacuum suction through the suction inlet.

Also, the apparatus further includes a reservoir installed in the housing to supply a dissolvent to the brush.

The cleaning blade is installed to be slanted with respect to the photoreceptor belt.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
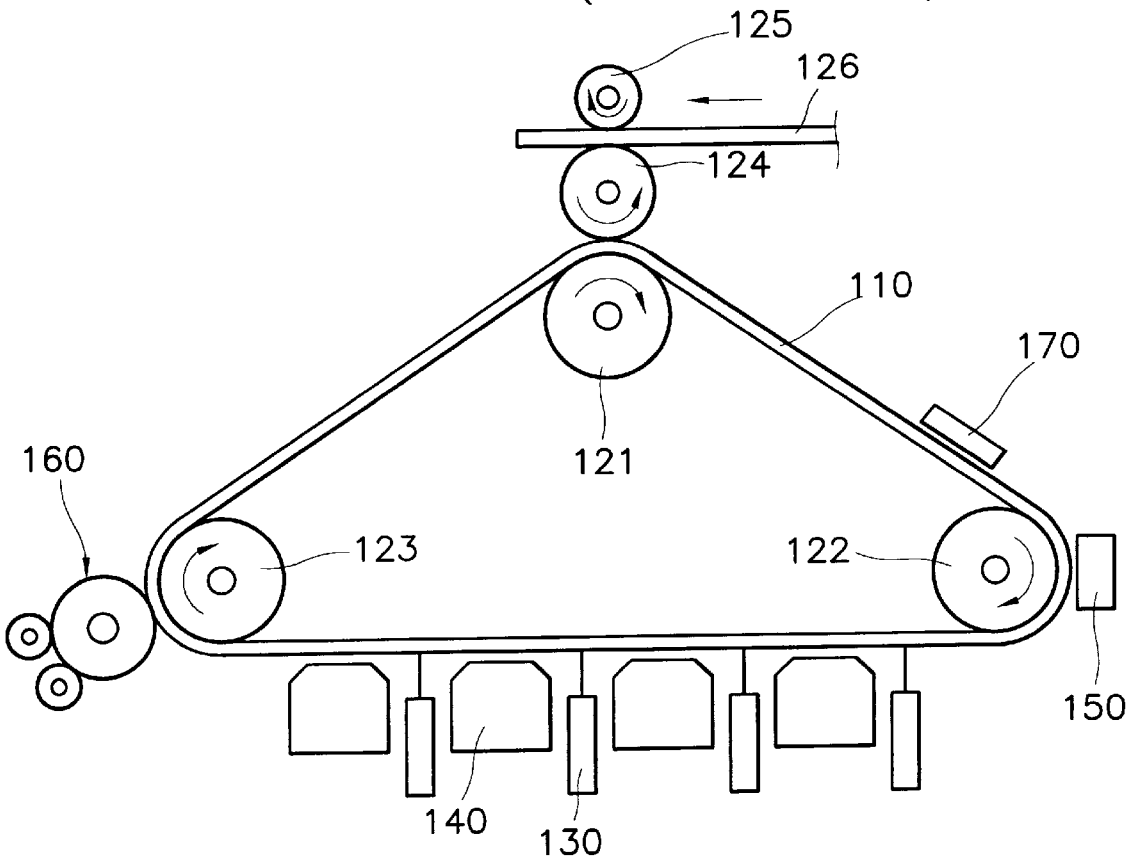
FIG. 1 (PRIOR ART)
FIG. 1 is a schematic diagram of a conventional liquid electrophotographic printer.
Figure 2:
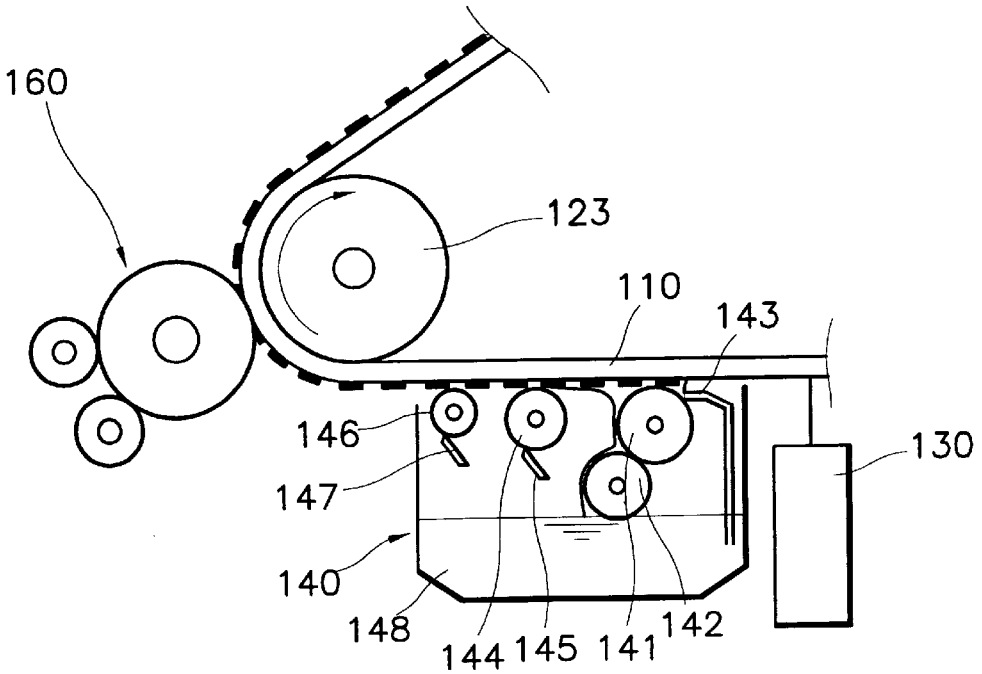
FIG. 2 (PRIOR ART)
FIG. 2 is a schematic diagram showing the development station shown in FIG. 1.
Figure 3:
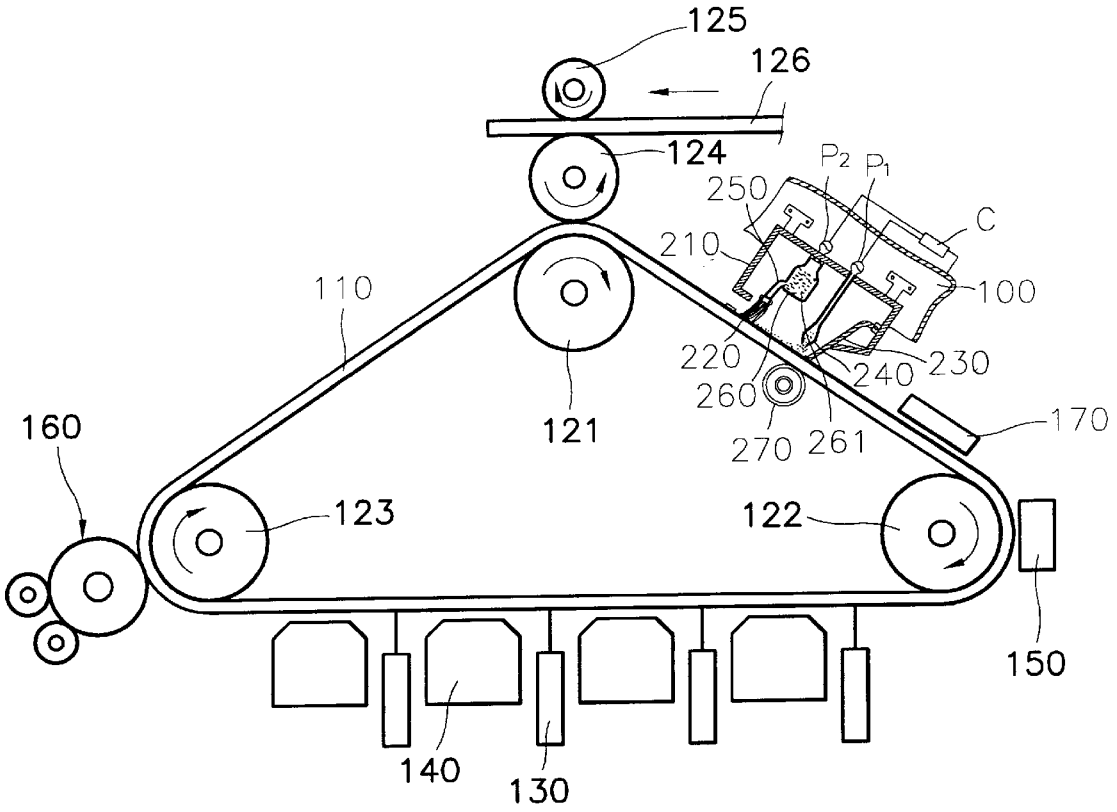
FIG. 3 is a schematic diagram of a liquid electrophotographic printer having a photoreceptor belt cleaning apparatus according to the present invention.
Figure 4:
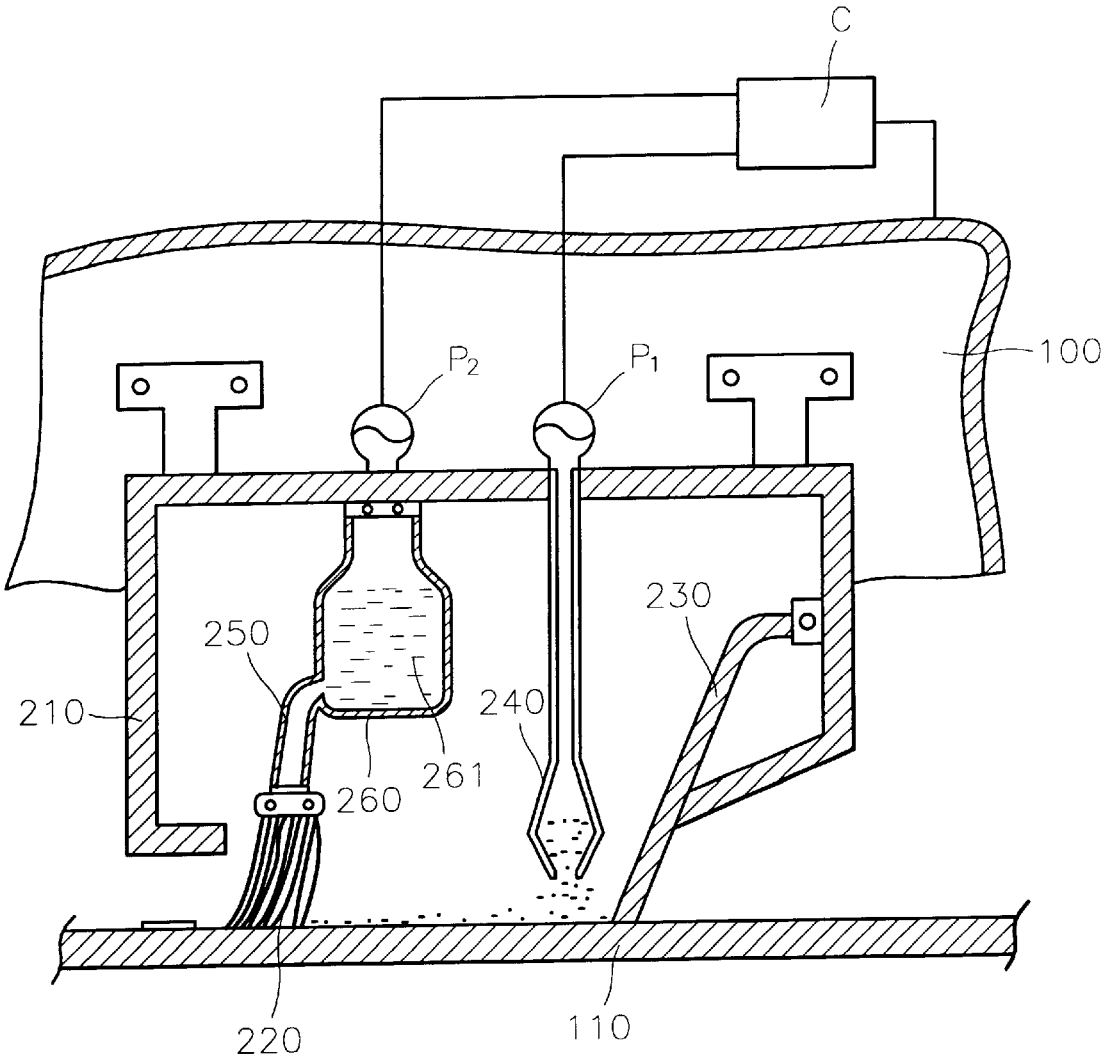
FIG. 4 is a schematic perspective view illustrating the photoreceptor belt cleaning apparatus shown in FIG. 3.

Referring to FIGS. 3 and 4, a photoreceptor belt cleaning apparatus of a liquid electrophotographic printer according to a first embodiment of the present invention will be described in detail. Here, the same reference numerals as those shown above represent the same elements.

The photoreceptor belt cleaning apparatus according to this embodiment, as shown in FIGS. 3 and 4, includes a housing 210 installed in a printer body frame 100 to be adjacent to the photoreceptor belt 110. In the housing 210, a brush 220 is installed to be brought into contact with the photosensitive surface of the photoreceptor belt 110. A cleaning blade 230 whose leading edge contacts the photoreceptor belt 110 is installed in the downstream side of the brush 220 in a traveling direction of the photoreceptor belt 110. A nozzle 240 having a suction inlet is installed in front of the cleaning blade 230. The nozzle 240 is connected to a pump (P1) so as to provide vacuum suction.

Also, the brush 220 is coupled to a dissolvent reservoir 260, for receiving a dissolvent 261. The dissolvent 261 is supplied to the brush 220 through a supply tube 250 by means of a pump (P2) installed in the dissolvent reservoir 260.

Reference character C represents a controller provided in the printer body frame 100. The driving states of the pump P1 and P2 can be controlled by manipulating the controller C. Reference numeral 270 represents a backup roller for supporting the photoreceptor belt 110 to prevent slack in the photoreceptor belt 110.

The photoreceptor belt cleaning apparatus of a liquid electrophotographic printer having the aforementioned configuration, according to the present invention, carries out the cleaning operation of the photoreceptor belt as described below.

If a cleaning switch (not shown) provided in the printer body frame 100 is turned on by an operator, the controller C drives the pump P2 to allow a small amount of the dissolvent 261 to be supplied to the brush 220. Thus, the small amount of dissolvent 261 supplied to the photosensitive surface of the photoreceptor belt 110 serves to separate the excess developer liquid or foreign matter from the photosensitive surface of the photoreceptor belt 110 due to contact between the brush 220 and the photoreceptor belt 110. The developer liquid or foreign matter separated from the photosensitive surface of the photoreceptor belt 110 moves along the traveling photoreceptor belt 110 and is caught at the leading edge of the cleaning blade 230 to be collected. The cleaning blade 230 is preferably slanted with respect to the photoreceptor belt 110 so as to facilitate collection of the developer liquid or foreign matter.

Also, the controller C drives the pump P1 simultaneously or at a predetermined time after the driving of the pump P2 so that the residual developer liquid or foreign matter caught in the leading edge of the cleaning blade 230 are sucked in through the nozzle 240.

According to another aspect of the present invention, a sensor (not shown) for sensing a mark (not shown) indicated on the photoreceptor belt 110 may be installed in the housing 210 or the printer body frame 100. The sensor senses the mark and transmits a signal representing the mark to the controller C. Then, the controller C calculates the traveling distance of the photoreceptor belt 110 and controls the above-described cleaning operation of the photoreceptor belt 110 to be performed periodically after printing is performed to a certain extent.

As described above, in the photoreceptor belt cleaning apparatus of a liquid electrophotographic printer, during a printing operation, residual developer liquid or contaminants stuck on the surface of a traveling photoreceptor belt can be cleaned by a cleaning belt on a real time basis, thereby improving printing quality. Also, the cleaning operation of the cleaning belt can be performed semipermanently only by replenishing the apparatus with a dissolvent.

It is conceivable that numerous modifications may be made to the photoreceptor belt cleaning apparatus of the liquid electrophotographic color printer of the present invention without departing from the spirit and scope of the invention as defined in the following claims.

What is claimed is:

1. A photoreceptor belt cleaning apparatus of a liquid electrophotographic printer comprising:

a photoreceptor belt circulating and supported by a plurality of rollers;

a housing installed to be adjacent to the photoreceptor belt;

a brush supported on the housing to be brought into contact with a photosensitive surface of the photoreceptor belt;

a cleaning blade installed in the downstream side of the brush in a traveling direction of the photoreceptor belt so that a leading edge of the cleaning blade contacts the photoreceptor belt;

a nozzle installed in the housing so that a suction inlet is disposed around the leading edge of the cleaning blade; and a first pump connected to the nozzle so as to provide vacuum suction through the suction inlet.

2. The photoreceptor belt cleaning apparatus according to claim 1, further comprising:

a reservoir installed in the housing to supply a dissolvent to the brush.

3. The photoreceptor belt cleaning apparatus according to claim 2, wherein a second pump supplies the dissolvent via a tube leading from said reservoir to the brush.

4. The photoreceptor belt cleaning apparatus according to claim 3, wherein a controller is provided in the housing for driving the first pump connected to the nozzle, and the second pump which supplies the dissolvent.

5. The photoreceptor belt cleaning apparatus according to claim 1, wherein the cleaning blade is installed to be slanted with respect to the photoreceptor belt.

6. The photoreceptor belt cleaning apparatus according to claim 1, further comprising:

a backup roller installed to face the cleaning blade with the photoreceptor belt interposed therebetween.

7. A photoreceptor belt cleaning apparatus of a liquid electrophotographic printer comprising:

a photoreceptor belt circulating and supported by a plurality of rollers;

a housing installed to be adjacent to the photoreceptor belt;

a brush supported on the housing to be brought into contact with a photosensitive surface of the photoreceptor belt;

a cleaning blade installed in the downstream side of the brush in a traveling direction of the photoreceptor belt so that a leading edge of the cleaning blade contacts the photoreceptor belt;

a nozzle installed in the housing so that a suction inlet is disposed around the leading edge of the cleaning blade;

a first pump connected to the nozzle so as to provide vacuum suction through the suction inlet;

a second pump for providing a dissolvent to the brush; and a controller for driving the first pump and the second pump.

* * * * *